US006024647A

United States Patent [19]

Bennett et al.

[11] Patent Number: 6,024,647

[45] Date of Patent: Feb. 15, 2000

[54] AMUSEMENT RIDE VEHICLE WITH MOTION CONTROLLED SEATING

[75] Inventors: Jeffrey W. Bennett, Venice, Calif.; Chad E. Brose, Eden Prairie, Minn.; Dale N. Maue, Eden Prairie, Minn.; Matthew A. Sauer, Eden Prairie, Minn.

[73] Assignee: Universal Studios, Inc., Universal City, Calif.

[21] Appl. No.: 09/103,911

[22] Filed: Jun. 24, 1998

[51] Int. Cl.[7] ..... A63G 1/00

[52] U.S. Cl. ..... 472/43; 472/59

[58] Field of Search ..... 472/43, 44, 57, 472/58, 59, 135, 136, 137; 104/53, 77, 78, 81, 83; 434/55, 29; 298/22 D, 22 B

[56] References Cited

U.S. PATENT DOCUMENTS

| | | | |
|---|---|---|---|
| 838,137 | 12/1906 | Plummer . | |
| 1,372,542 | 3/1921 | Peterson . | |
| 1,380,730 | 7/1921 | Miller . | |
| 2,861,806 | 11/1958 | Disney . | |
| 3,602,499 | 8/1971 | Kojima . | |
| 3,923,300 | 12/1975 | Tanus . | |
| 4,461,470 | 7/1984 | Astroth et al. . | |
| 4,642,945 | 2/1987 | Browning et al. . | |
| 4,874,162 | 10/1989 | Trumbull et al. . | |
| 4,879,849 | 11/1989 | Hollingsworth, III et al. | 52/10 |
| 5,015,933 | 5/1991 | Watkins et al. . | |
| 5,165,389 | 11/1992 | Jing-Qi et al. . | |
| 5,199,875 | 4/1993 | Trumbull . | |
| 5,403,238 | 4/1995 | Baxter et al. | 472/43 |
| 5,513,990 | 5/1996 | Gluck . | |
| 5,533,933 | 7/1996 | Garnjost et al. | 472/60 |
| 5,678,889 | 10/1997 | Purcell, Jr. | 297/257 |

*Primary Examiner*—Kien T. Nguyen
*Attorney, Agent, or Firm*—Lyon & Lyon LLP

[57] ABSTRACT

An amusement ride vehicle with motion controlled seating includes a chassis supporting a platform. Guests are transported through an amusement attraction in seating attached to the platform. Preferably, the guests ride in a chair having a hinged seat pan adapted to effect a bouncing motion or a chair adapted to effect a rocking motion. An actuator is advantageously provided to move the chair at a predetermined time. In a preferred embodiment, a triggering mechanism drops the seat pan from an inclined position to a declined position at a predetermined time, and a reset assembly returns the seat pan to the inclined position.

28 Claims, 7 Drawing Sheets

AMUSEMENT RIDE VEHICLE WITH MOTION CONTROLLED SEATING

BACKGROUND OF THE INVENTION

The field of the invention is amusement ride vehicles.

Amusement rides are constantly evolving to provide a better entertainment experience. Roller coasters, for example, are being designed to go faster and higher and free-falling devices to fall from higher elevations. These basic concepts, however, have remained unchanged: a guest is seated in a stationary chair mounted to a moving ride vehicle.

Other entertainment industries, such as the motion picture and video game industries, are predominantly a visual and auditory experience. In an attempt to simulate the physical stimulation of an amusement ride to provide a more complete entertainment experience, motion controlled seating has recently been employed. For example, a motion picture theatre may have motion controlled seats synchronized to simultaneously move with a visual effect on the screen and a corresponding sound effect in stereo. As amusement rides have been predominantly a physical experience, the concept of using motion controlled seating in an amusement ride has not previously been used. Furthermore, few, if any, of the visual and auditory improvements of the motion picture and video game industries have been used in an amusement ride. Having recognized these conditions, the invention provides an improved amusement ride vehicle with motion controlled seating.

SUMMARY OF THE INVENTION

To this end, an amusement ride includes a vehicle which moves along a path. Guests are transported through an amusement attraction while riding in seats in the vehicle. Preferably, the guests ride in a chair having a hinged seat pan adapted to effect a bouncing motion or a rocking chair assembly adapted to effect a rocking motion. An actuator assembly is advantageously provided to move the chair at a predetermined time. In a preferred embodiment, a triggering mechanism drops the seat pan from an inclined position to a declined position at a predetermined time. Both active and passive systems may be used to move the chair when the amusement ride vehicle is in motion. In an active system, the seat is preferably raised up and then lowered by a motor or actuator on the vehicle. In a passive system, the seat is dropped or lowered and then reset to its original position by an actuator or mechanism off board of the vehicle, such as a cam rail. Preferably, the chair is synchronized to move with a simultaneous sound and a corresponding visual effect.

Accordingly, it is an object of the present invention to provide an amusement ride vehicle that has motion controlled seating. Other and further objects and advantages of the present invention will be further understood and appreciated by those skilled in the art by reference to the following specification, claims, and drawings.

BRIEF DESCRIPTION OF THE DRAWINGS

Similar reference characters denote corresponding features consistently throughout the drawings.

DETAILED DESCRIPTION OF THE PREFERRED EMBODIMENTS

Figure 1:
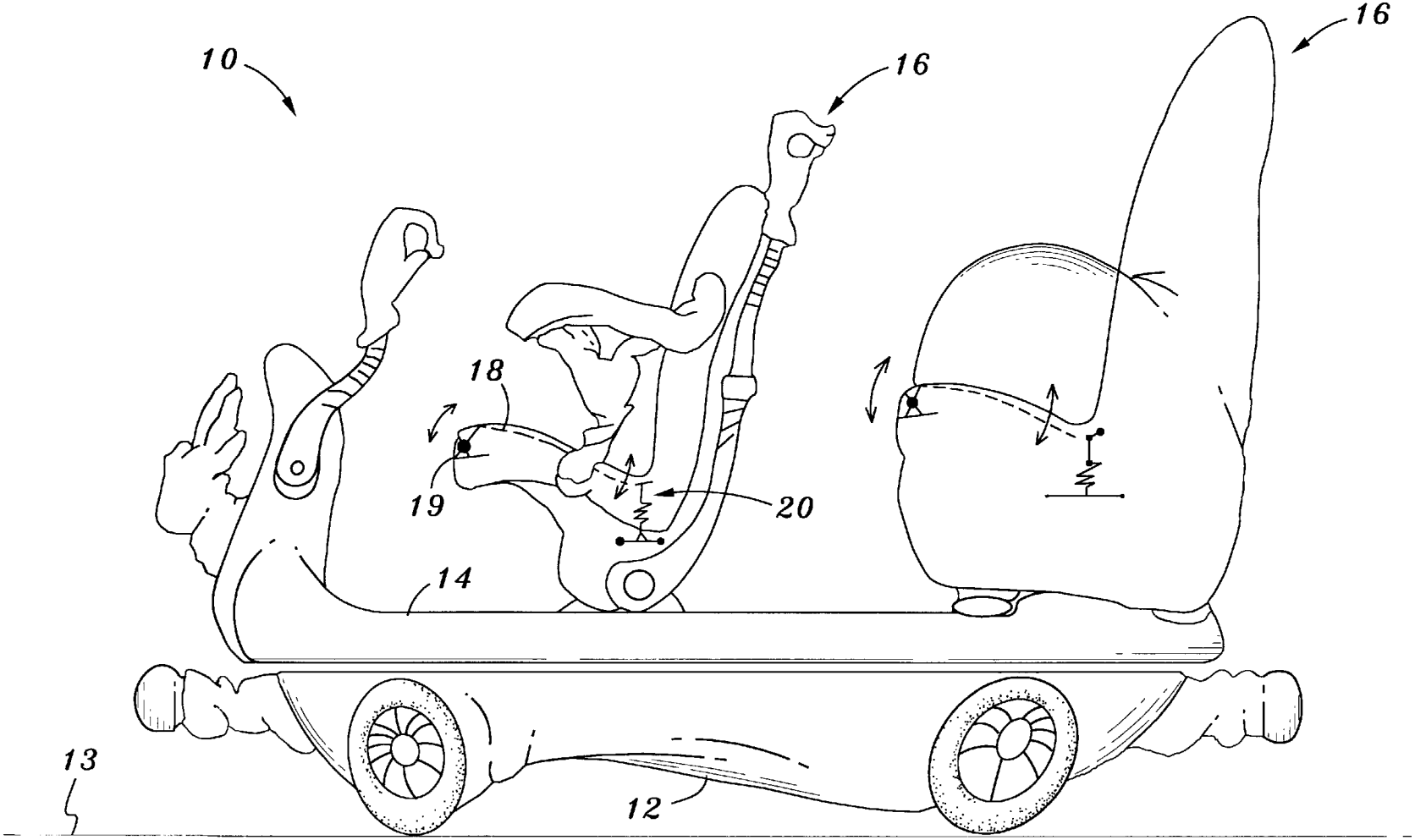
FIG. 1 is a left side view of an amusement ride vehicle showing chair movement of the active pneumatic, passive pneumatic, and mechanical motion controlled seating systems.
Figure 2:
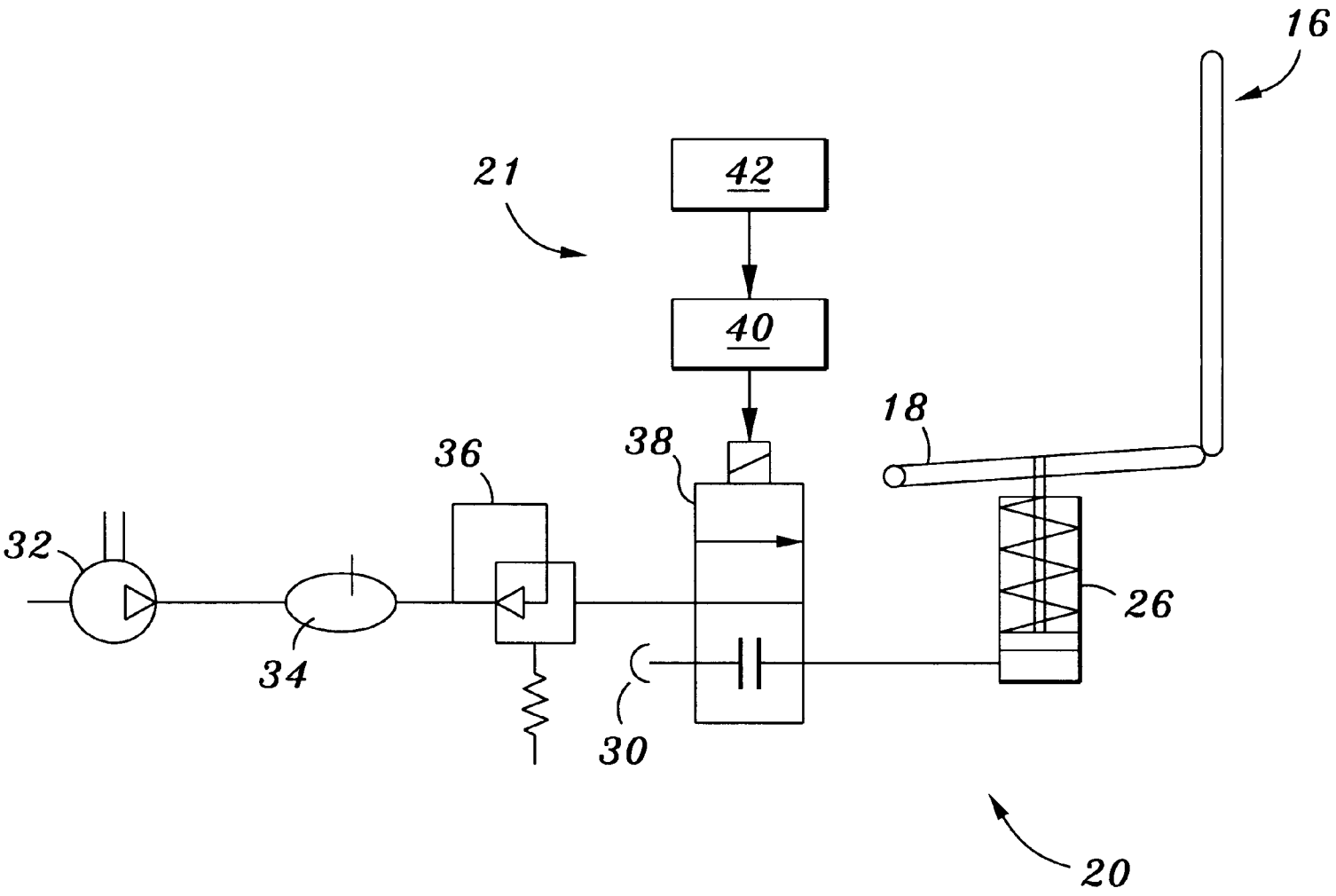
FIG. 2 is a schematic representation of the active pneumatic motion controlled seating system.

Turning in detail to the drawings, as shown in FIGS. 1 and 2, the amusement ride vehicle 10 with motion controlled seating includes a chassis 12 supporting a platform 14. Seats are provided in the vehicle. The vehicle 10 follows a path or track 13 as it transports riders sitting on seats through an amusement attraction. The seats preferably comprise two guest chairs 16, each accommodating three guests.

FIG. 1 shows a chair 16 having a hinged seat pan 18 hinged at the front at pivot pin 19. An actuator assembly 20 supports the chair 16 opposite the pivot pin 19. FIG. 2 shows one embodiment of an active pneumatic motion controlled seating system. This system, which is on the vehicle, raises the hinged seat pan 18, approximately one inch, to an inclined position and subsequently drops the seat pan 18 at a predetermined time. The active pneumatic motion controlled seating system includes a pneumatic actuator 26 for supporting the seat pan 18 and an electronic triggering mechanism 21 for dropping the seat pan 18 once raised. The seat pan 18 is raised by compressed air. To this end, compressed air is generated by a compressor 32, accumulated in an accumulator tank 34, and regulated by a pressure regulator 36 connected to a solenoid valve 38. When triggered, the solenoid valve 38 opens to allow compressed air to alternately enter or exit the pneumatic actuator 26. The solenoid valve 38 is triggered by a trigger 40 linked to a control system 42. An exhaust line 30 connected to the pneumatic actuator 26 enables air that has entered into the pneumatic actuator 26 to be exhausted.

In operation, the guests board the vehicle 10 with the seat pans 18 in the declined position. When triggered by an electronic signal from the control system 42, the solenoid valve 38 opens allowing compressed air to enter the pneumatic actuator 26, rapidly raising the seat pan 18 to the inclined position. After the seat pan 18 reaches the inclined position, the solenoid valve 38 immediately returns to normal, allowing the pneumatic actuator 26 to return the seat pan 18 to the declined position by exhausting air in the pneumatic actuator 26 out through the exhaust line 30. This cycle is then ready to be repeated. The entire process takes less than one second to produce a bouncing effect. This physical experience is preferably synchronized with a simultaneous sound and corresponding visual effect.

Figure 3:
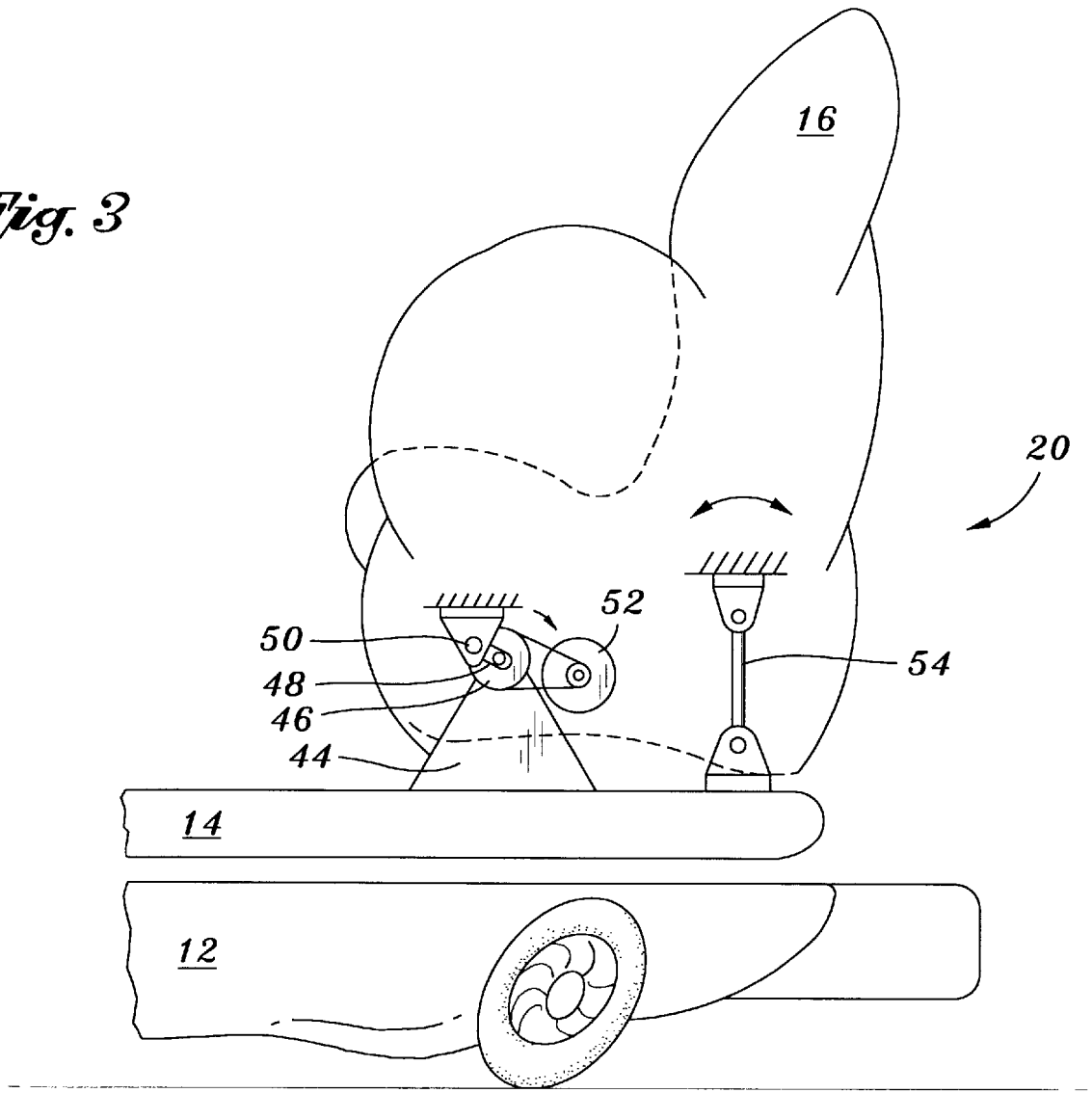
FIG. 3 is a left side view of an amusement ride vehicle showing an active mechanical motion controlled seating system and chair assembly movement using this system.

FIG. 3 shows one embodiment of an active mechanical motion controlled seating system. In this system, the entire chair 16 is articulated to move, rather than simply the seat pan 18. The active mechanical actuator system preferably includes an electric gear motor 44 mounted to the platform 14 and a drive 46 engageable by the motor 44. A crankshaft 48 is rotatable by drive 46, while a linkage arm 50 is connected to the crankshaft 48 in an offset manner. The crankshaft 48 supports the front of the chair 16. Drive 46 also engages drive 52 which in turn rotates a second linkage arm 54. This second linkage arm 54 supports the rear of the chair 16. Advantageously, this particular actuator assembly 20 permits the entire chair 16 to move both up/down and fore/aft when triggered by an electronic signal from a control system 42 similar to the one shown in FIG. 2.

In operation, the guests board the vehicle 10 when the chair 16 is in an at-rest position. At the preferred time, when triggered by an electric signal from the control system 42, the crankshaft 48 turns and simultaneously moves the entire chair assembly 16 both up/down and fore/aft. The motor 44 is controlled to stop after the crankshaft 48 completes one full revolution. This cycle is completed in less than one second. The guests experience a rocking effect similar to riding horseback or being in a small boat at sea. An additional feature of this system is that it can operate in a continuous mode, with the crankshaft 48 continuing to turn rather than stopping after each cycle.

FIGS. 4–8 show an amusement ride system utilizing one embodiment of a passive mechanical motion controlled seating system. In this system, an actuator assembly 20 preferably supports the seat pan 18 of the chair 16 in an inclined position (shown in FIG. 6 by the dotted lines), a trip mechanism 22 drops the hinged seat pan 18 from the inclined position to a declined position (shown in FIG. 6 by the solid lines) at a predetermined time, and a reset assembly 24 raises the seat pan 18, approximately one inch, to the inclined position.

The actuator assembly 20 includes a bump mechanism 58 and a linkage mechanism 60. Shown in FIGS. 4–6, the bump mechanism 58 has two bump arms 62, a stop 64 mounted to each bump arm 62, and a roller 66 rotatably connected to each bump arm 62. The stop 64 is preferably a hard stop or rubber bumper. The linkage mechanism 60 includes a torque shaft 68 mounted to the chair 16. Torque shaft 68 has a bump arm 62 mounted at each end thereof. Cam 70 protrudes from torque shaft 68. Another torque shaft 72 is mounted to the platform 14 with two additional cams 74, 76. Linkage arm 78 connects cam 70 to cam 74. Shown in FIG. 4, another linkage arm 80, preferably mounted on the right hand side of the vehicle 10, connects the actuator assembly 20 of the front chair 16 to the actuator assembly 20 of the rear chair 16. The actuator assembly 20 of the rear chair 16 also includes a bump mechanism 58 and a linkage mechanism 60. The linkage mechanism 60 of this actuator assembly 20 includes torque shaft 68 mounted to the rear chair 16 having cam 70, torque shaft 72 mounted to the platform 14 having cam 74 and cam 76, and linkage arm 78 connecting cam 70 to cam 74. Linkage arm 80 connects cam 76 of torque shaft 72 of the actuator assembly 20 of the front chair 16 to cam 76 of torque shaft 72 of the actuator assembly 20 of the rear chair 16.

Figure 7:
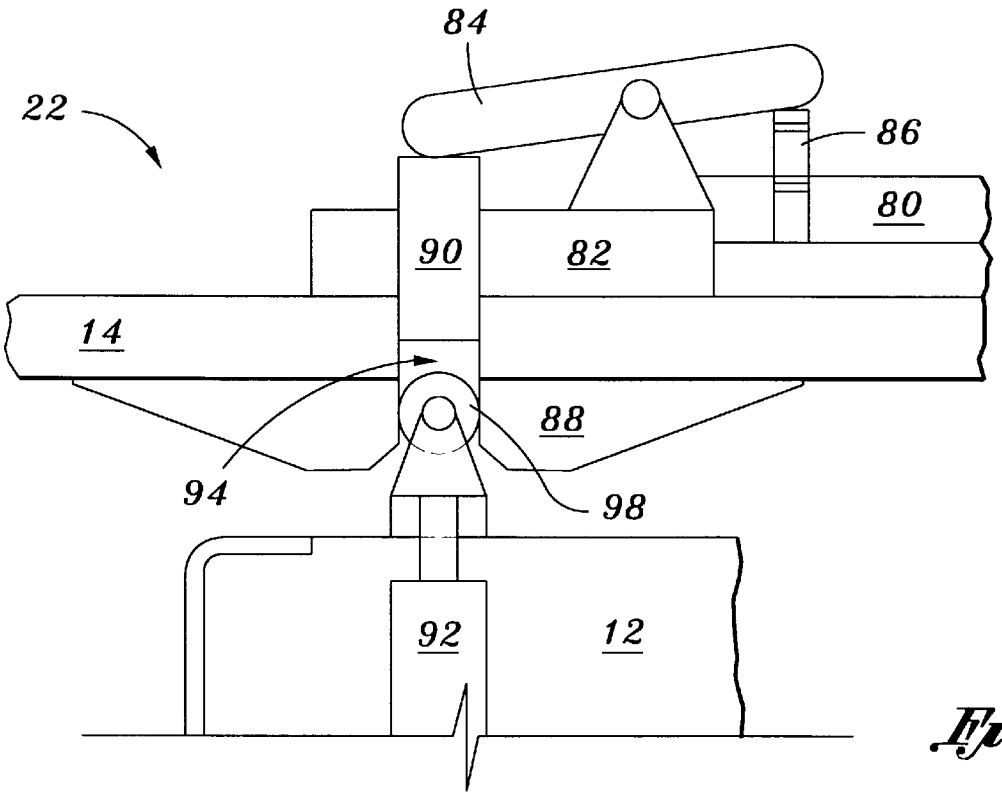
FIG. 7 is a left side view of the trip mechanism of the vehicle shown in FIG. 4.

Referring in detail to FIG. 7, the trip mechanism 22 includes a trip mounting block 82 mounted to the platform 14, a rocker arm 84, a trip lever 86, an engagement block 88, a tappet 90, and a cam follower 92. The trip mounting block 82 has a tappet receiving slot 94. The rocker arm 84 is supported by the trip mounting block 82, and the trip lever 86 is connected to the passive mechanical means 20 near the rocker arm 84. The engagement block 88 mounted to the platform 14 opposite the trip mounting block 82 has a tappet receiving slot 94 for slideably engaging the tappet 90 therethrough. The cam follower 92, mounted to the chassis 12, has a locking wheel 98 engageable with the tappet 90 and the cam rail 56.

Figure 4:
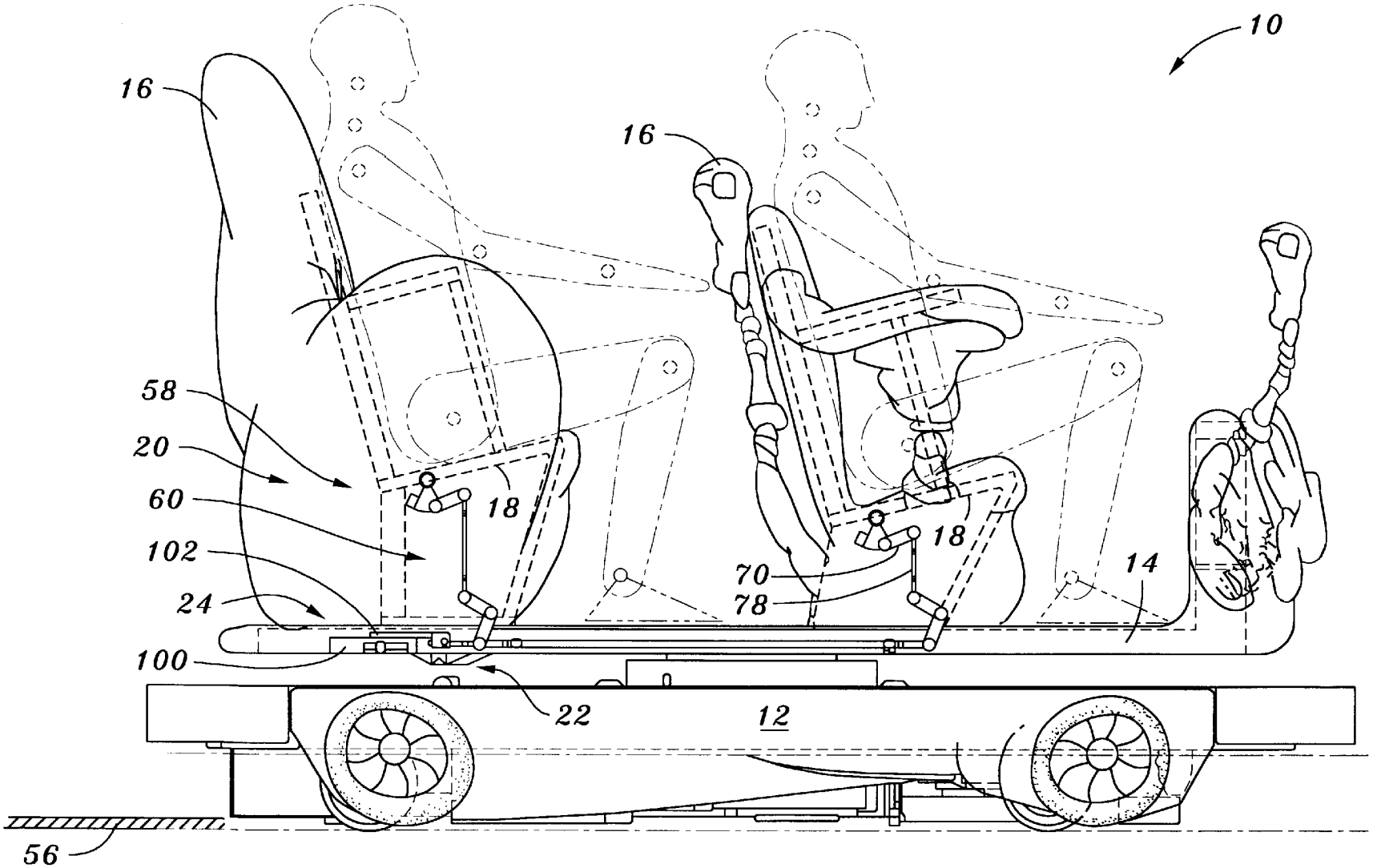
FIG. 4 is a right side view of an amusement ride vehicle showing a passive mechanical motion controlled seating system.
Figure 5:
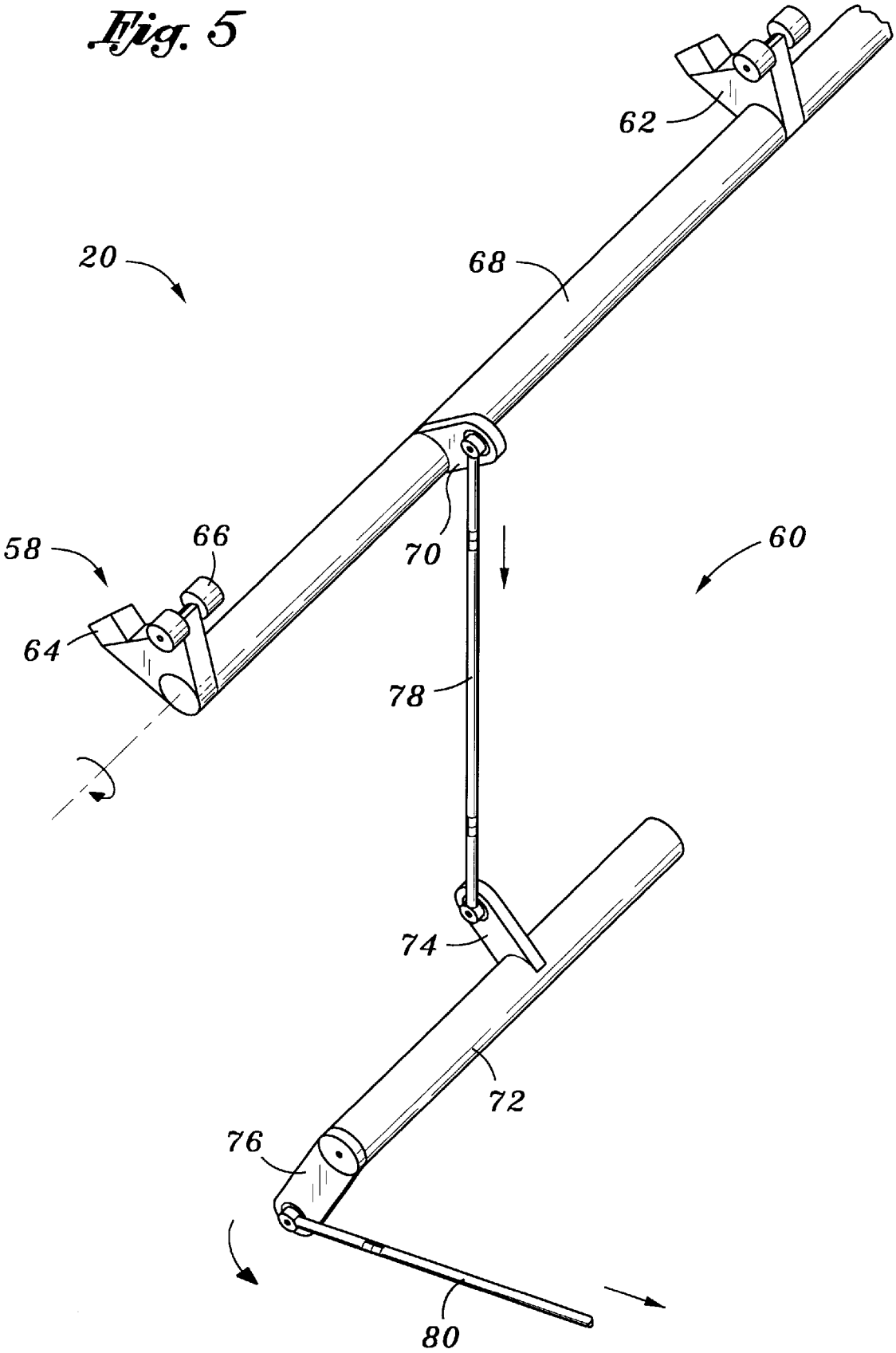
FIG. 5 is a perspective view of the passive mechanical actuator assembly of the vehicle shown in FIG. 4.
Figure 6:
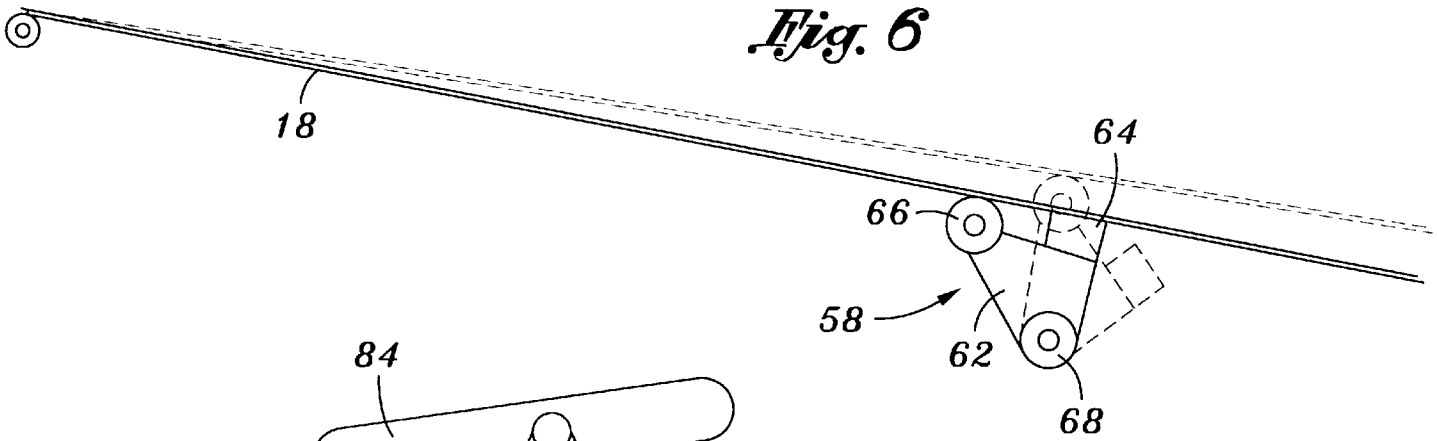
FIG. 6 is a left side view of the seat pan and bump mechanism of the passive mechanical actuator assembly of the vehicle shown in FIG. 4 with the dotted lines illustrating the inclined seat pan position and the solid lines illustrating the declined seat pan position.

Shown in FIG. 4, the reset assembly 24 includes a reset mounting block 100 preferably mounted on the right rear corner of the platform 14, a third linkage arm 102 supported by the reset mounting block 100 and adapted to engage the tappet 90, and the cam follower 92 mounted to the chassis 12. The locking wheel 98 of the cam follower 92 engages the third linkage arm 102 and the cam rail 56.

Figure 8:
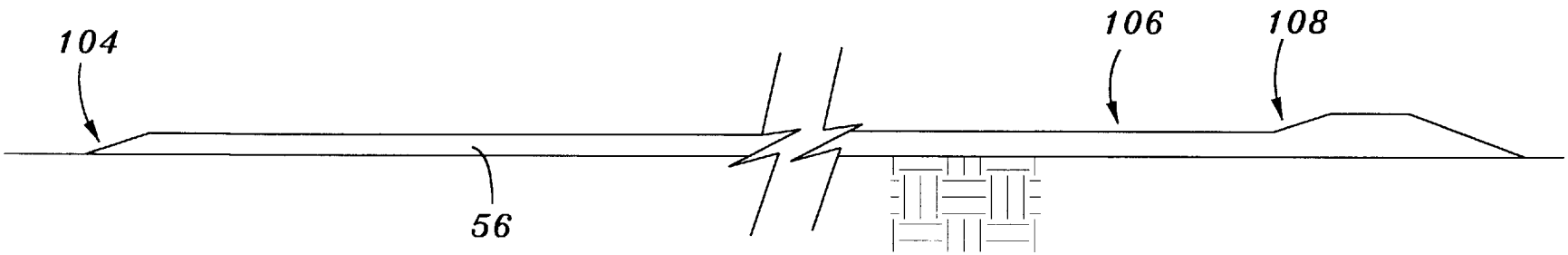
FIG. 8 is side view of the cam rail of the amusement ride vehicle system employed by the vehicle shown in FIG. 4.

The cam rail 56, seen in FIG. 8, starts at the station and is extended into the attraction to the location where a bouncing motion or bump effect is desired. Preferably, this physical experience is synchronized with a simultaneous sound and visual effect. The cam rail 56 is variably raised to include a reset position 104, a home lock position 106, and a bump position 108. The reset position 104 is located in the buffer zone between unload and load areas, where it would not be seen by guests. At the reset position 104, the cam rail 56 ramps up approximately one inch. The bump position 108 is the point on the cam rail 56 where the bouncing motion is triggered. At the bump position 108, the cam rail 56 ramps up approximately one additional inch and then ramps back down to zero.

In operation, the guests board the vehicle 10 when the seat pan 18 is in the inclined position. At the bump position 108, the cam follower 92 lifts the locking wheel 98, which engages the trip mechanism 22. When tripped, the tappet 90 moves away from the cam rail 56, causing the rocker arm 84 to rotate and the trip lever 86 to engage the linkage arm 80. This in turn causes the bump arm torque shaft 68 to be turned slightly in a counter-clockwise direction. The bump arm 62 then rotates past top dead center, turning approximately forty-five degrees, allowing the seat pan 18 to drop by approximately one inch to the declined position. The seat pan 18 rests against the stop 64. After the vehicle 10 enters the station and unloads the guests, the cam follower 92 of the vehicle 10 engages reset position 104 of the cam rail 56 before the load area. When engaged, the cam follower 92 lifts the locking wheel 98 which engages the third linkage arm 102, forcing the tappet 90 to slide toward the cam rail 56 which then returns the seat pan 18 to the inclined position and resets the trip mechanism 22.

In another passive mechanical system, the vehicle and seating design are similar to the pneumatic system shown in FIG. 2, but with the pneumatic actuator 26 and solenoid valve 38 replaced by a mechanical linkage. While a "weak knee" type of mechanical linkage is preferred, other mechanical linkages may also be employed. When the guests board the vehicle 10, the seat is in the inclined position. When triggered, the mechanical linkage is tripped, causing the seat pan 18 to drop rapidly. At the end of its travel, the seat pan 18 preferably falls against a spring for slowly engaging the seat pan 18 after being dropped by the triggering mechanism 21. After guests unload from the vehicles 10, the seat pans 18 are returned to the original inclined position by at least one steel spring or reset means 24.

A passive pneumatic motion controlled seating system is similar to the active pneumatic system shown in FIG. 2, except that there is no air compressor 32, accumulator tank 34, or pressure regulator 36. With the passive pneumatic motion control seating system, a pneumatic actuator 26, preferably gas charged, supports one end of the seat pan 18. Reset means 24 is a return spring for allowing air to enter the pneumatic actuator 26. A control system 42 connected to a trigger 40, which is in turn connected to a solenoid valve 38 having an exhaust line 30, permits air to be exhausted from the pneumatic actuator 26 at a predetermined time.

In operation, the guests board the vehicle 10 when the seat pan 18 is in the inclined position. When triggered, the solenoid valve 38 opens allowing air to be exhausted from the pneumatic actuator 26. This causes the seat pan 18 to drop rapidly. After the guests unload from the vehicles 10, the seat pans 18 are returned to the original inclined position by the reset means 24.

Thus, an amusement ride vehicle with motion controlled seating providing a complete entertainment experience has been disclosed. While embodiments and applications of this invention have been shown and described, it would be apparent to those skilled in the art that many more modifications are possible without departing from the inventive concepts herein. For example, electrical actuators or hydraulic actuators may readily be used as known equivalents in place of the pneumatic and mechanical actuators described. In addition, the mechanical linkages shown are merely the preferred designs, and many equivalent alternatives may be substituted within the spirit of the invention. The invention, therefore is not to be restricted except in the spirit of the appended claims.

What is claimed is:

1. An amusement ride vehicle comprising:

a chassis;

a platform supported by the chassis;

a seat pivotably supported by the platform, the seat being pivotably moveable between an inclined and a declined position with respect to the platform;

an actuator linked to the seat; and a triggering mechanism for triggering the actuator.

2. The amusement ride vehicle according to claim 1 wherein the actuator is a pneumatic actuator.

3. The amusement ride vehicle according to claim 1 wherein the actuator includes a first linkage arm connected to a second linkage arm.

4. The amusement ride vehicle according to claim 1 wherein the triggering mechanism is synchronized to engage the actuator to move the seat with a simultaneous sound effect.

5. An amusement ride vehicle comprising:

a chassis;

a platform supported by the chassis;

a seat pivotably supported by the platform;

an actuator attached to the seat, the seat being moveable between an inclined and a declined position with respect to the platform; and means for energizing the actuator to move the seat at a predetermined time.

6. The amusement ride vehicle according to claim 5 wherein the actuator includes a linkage mechanism for supporting the seat in an inclined position and a bump mechanism connected to the linkage mechanism.

7. A vehicle for transporting guests through an amusement ride attraction, the vehicle comprising:

a chassis having a platform;

a chair supported by the platform, the chair having a hinged seat pan;

an active pneumatic system for raising the seat pan away from the platform and subsequently dropping the seat pan toward the platform at a predetermined time.

8. The vehicle according to claim 7, the active pneumatic system including a pneumatic actuator supporting the seat pan at one end thereof, an air system for causing compressed air to enter the pneumatic actuator, and an exhaust line connected to the pneumatic actuator.

9. The vehicle according to claim 8, wherein the air system includes a compressor, an accumulator tank connected to the compressor, a pressure regulator connected to the accumulator tank, and a solenoid valve connected to the pressure regulator and the pneumatic actuator.

10. The vehicle according to claim 9, further comprising a trigger connected to the solenoid valve and a control system connected to the trigger.

11. The vehicle according to claim 8 wherein the seat pan is hingedly connected to the platform opposite the pneumatic actuator.

12. An amusement ride comprising:

a path;

a vehicle movable along the path;

a platform on the vehicle;

an active mechanical actuator assembly supported by the platform;

a chair attached to the active mechanical actuator assembly via a pivot joint, to effect a rocking motion with respect to the platform at a predetermined time.

13. An amusement ride vehicle system comprising:

a vehicle having a platform;

a chair having a hinged seat pan supported by the platform;

a passive mechanical actuator assembly for supporting the hinged seat pan in an inclined position;

a trip mechanism for dropping the hinged seat pan to a declined position at a predetermined time;

a reset mechanism for raising the seat pan from the declined position to the inclined position; and a cam rail for engaging the reset mechanism.

14. The amusement ride vehicle system according to claim 13, the passive mechanical actuator assembly including a bump mechanism and a linkage mechanism.

15. The amusement ride vehicle system according to claim, 14, the bump mechanism including a first bump arm and an opposing second bump arm, a stop mounted to each bump arm, and a roller rotatably connected to each bump arm.

16. The amusement ride vehicle system according to claim 15, the linkage mechanism including a first torque shaft mounted to the chair, the first torque shaft having a first cam, a second torque shaft mounted to the platform, the second torque shaft having a second cam and a third cam, and a first linkage arm connecting the first cam to the second cam.

17. The amusement ride vehicle system according to claim 15, the bump mechanism including a bump arm mounted at each end of the first torque shaft.

18. The amusement ride vehicle system according to claim 13 further comprising a second chair having a hinged seat pan, a second passive mechanical actuator assembly for supporting the seat pan of the second chair in an inclined position, and a linkage arm connecting the first passive mechanical assembly to the second passive mechanical actuator assembly.

19. The amusement ride vehicle system according to claim 18, the linkage mechanism of the second passive mechanical actuator assembly including a first torque shaft mounted to the second chair, the first torque shaft having a first cam, a second torque shaft mounted to the platform, the second torque shaft having a second cam and a third cam, and a linkage arm connecting the first cam to the second cam.

20. The amusement ride vehicle system according to claim 19, the linkage arm connecting the third cam of the second torque shaft of the first passive mechanical actuator assembly to the third cam of the second torque shaft of the second passive mechanical actuator assembly.

21. The amusement ride vehicle system according to claim 13, the trip mechanism including a trip mounting block mounted to the platform, the trip mounting block having a tappet receiving slot, a rocker arm supported by the trip mounting block, a trip lever connected to the passive mechanical actuator assembly near the rocker arm, an engagement block mounted to the platform opposite the trip mounting block, the engagement block having a tappet receiving slot, a tappet slideably engageable in the tappet receiving slot of the trip mounting block and the tappet receiving slot of the engagement block, and a cam follower having a locking wheel engageable with the tappet and the cam rail.

22. The amusement ride vehicle system according to claim 13, the reset assembly including a reset mounting block mounted to the platform, a linkage arm supported by the reset mounting block and adapted to engage the tappet, and a cam follower having a locking wheel engageable with the linkage arm and the cam rail.

23. The amusement ride vehicle system according to claim 13, the cam rail being variably raised to include a reset position, a home lock position, and a bump position.

24. An amusement ride comprising:

a vehicle adapted to move along a path;

a seat pivotably supported by the platform, the seat being pivotably moveable between an inclined and a declined position with respect to the platform;

a cam rail extending along part of the path; and a linkage for transmitting a motion profile of the cam to the seat.

25. A method of operating an amusement ride, comprising the steps of:

moving a ride vehicle along a path;

vertically displacing a seat in the vehicle relative to a platform of the ride vehicle at a predetermined time or at a predetermined location along the path, by pivoting one end of the seat; and resetting the seat to its original position.

26. A ride vehicle with motion controlled seating comprising:

a platform;

an active mechanical actuator assembly supported by the platform,the active mechanical actuator assembly including a motor mounted to the platform, a first drive engageable by the motor, a crankshaft rotatable by the first drive, a first linkage arm connected to the crankshaft, a second drive engageable by the first drive, and a second linkage arm rotatably driven by the second drive; and a chair mounted to the active mechanical assembly and adapted to effect a rocking motion with respect to the platform at predetermined time.

27. The ride vehicle according to claim 26, the chair having a front and a rear, the crankshaft supporting the front of the chair and the second linkage arm supporting the rear of the chair.

28. The ride vehicle according to claim 26, the crankshaft being offset from the first linkage arm.

* * * * *